US006962138B2

(12) United States Patent
Garrick et al.

(10) Patent No.: US 6,962,138 B2
(45) **Date of Patent: *Nov. 8, 2005**

(54) THROTTLE CONTROL FOR A SMALL ENGINE

(75) Inventors: Robert D. Garrick, Rochester, NY (US); Donald G. Witzel, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 185 days.

This patent is subject to a terminal disclaimer.

(21) Appl. No.: 10/238,836

(22) Filed: Sep. 6, 2002

(65) Prior Publication Data

US 2004/0045523 A1 Mar. 11, 2004

(51) Int. Cl.[7] ..... F02D 9/12
(52) U.S. Cl. ..... 123/337; 123/361; 123/399
(58) Field of Search ..... 251/129.22; 123/337, 123/361, 399, 339, 27

(56) References Cited

U.S. PATENT DOCUMENTS 4,402,344 A * 9/1983 Kemmner ..... 251/129.22
4,989,564 A * 2/1991 Cook et al. ..... 123/339.27
5,704,335 A * 1/1998 Akutagawa et al. ..... 123/337
6,065,447 A * 5/2000 Saeki et al. ..... 123/339.27
6,167,867 B1 1/2001 Garrick
6,308,671 B1 10/2001 Reed et al.
6,454,242 B1 9/2002 Garrick et al.
6,522,038 B2 2/2003 Byram
6,571,782 B2 * 6/2003 Brosseau et al. ..... 123/337
6,600,989 B2 7/2003 Sellnau et al.
6,619,258 B2 9/2003 McKay et al.
6,622,696 B2 * 9/2003 Witzel et al. ..... 123/337

* cited by examiner

*Primary Examiner*—Erick Solis
(74) *Attorney, Agent, or Firm*—Jimmy L. Funke

(57) ABSTRACT

A speed control apparatus for an internal combustion engine including a poppet valve seat and a poppet valve pintle assembly disposed coaxially for variably regulating the flow of air into the engine across the valve seat. The pintle is axially positioned by a stepper motor actuator responsive to an engine speed sensor and electronic controller. The controller varies the axial position of the pintle in accordance with a programmed algorithm to provide any desired engine speed, and especially a fixed engine speed, under a range of engine loads. The invention eliminates the need for a governor, rotary mechanical throttle, and cable or mechanical linkages, and is especially useful for small engine applications such as in powering a portable electric generator, yard equipment, or outboard motor.

9 Claims, 4 Drawing Sheets

THROTTLE CONTROL FOR A SMALL ENGINE

TECHNICAL FIELD

The present invention relates to means for controlling the speed of an internal combustion engine; more particularly, to valve means for throttling the flow of combustion air into an internal combustion engine; and most particularly, to a poppet valve throttle system for controlling the speed of a small internal combustion engine, and especially a fixed speed.

BACKGROUND OF THE INVENTION

Prior art internal combustion engines typically employ a butterfly-type valve for throttling the volume of air admitted to the engine. Such a valve comprises a rotatable shaft mounted transversely of an engine manifold inlet and supporting a plate which may be rotated by the shaft to variably occlude the inlet.

In many applications, especially non-automotive, an engine may be required to operate for long periods of time at a substantially constant speed with variable load. For example, an electrical generator is ideally operated at 3600 rpm (60 Hz) to maintain 60 Hz power output. Also, an engine manufacturer may specify a particular engine speed as providing peak efficiency or peak power, for example, for use on a lawnmower or a shredder.

In the prior art, controlling an engine to a fixed speed under a variety of loads requires additional engine components such as vacuum or oil governor systems. Typically, these governor systems connect the throttle to a spring linkage and/or cable mechanism that adjusts the throttle angle of the butterfly valve plate to adjust the effective cross-sectional flow area of the inlet to meet the air flow requirement of the engine. Such systems typically are of low accuracy and add significant numbers of components, and thus cost and complexity, to an engine. Such systems are also prone to failure from clogging or damage by environmental debris such as grass, stones, and wood chips.

What is needed is a simple, inexpensive throttle control system for reliably and accurately controlling the speed of an internal combustion engine under varying load conditions.

It is a principal object of the present invention to control the speed of an internal combustion engine under varying load conditions.

It is a further object of the present invention to control the speed of an internal combustion engine at a fixed speed.

It is a still further object of the invention to increase the reliability and accuracy of fixed speed control of an engine.

It is a still further object of the invention to reduce the complexity and manufacturing cost of an internal combustion engine, and especially a small engine used for non-automotive purposes.

SUMMARY OF THE INVENTION

Briefly described, in an internal combustion engine in accordance with the invention, a combustion air inlet for an intake plenum, manifold, or port is provided with a poppet valve seat, preferably circular. A valve pintle, comprising a shaft and valve head, is disposed coaxially with the valve seat for variably regulating the flow of air into the engine across the valve seat. The pintle is axially positioned by an actuator, preferably a stepper motor, responsive to an engine speed sensor and electronic controller. The controller varies the position of the pintle in accordance with a programmed algorithm to provide any desired engine speed, and especially a fixed engine speed, under a range of engine loads.

The invention reduces the complexity of engine construction by eliminating the need for a governor, rotary mechanical throttle, and cable or mechanical linkages.

The invention is especially useful for small (one- or two-cylinder) engine applications such as in powering a portable electric generator, yard equipment, or outboard motor.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
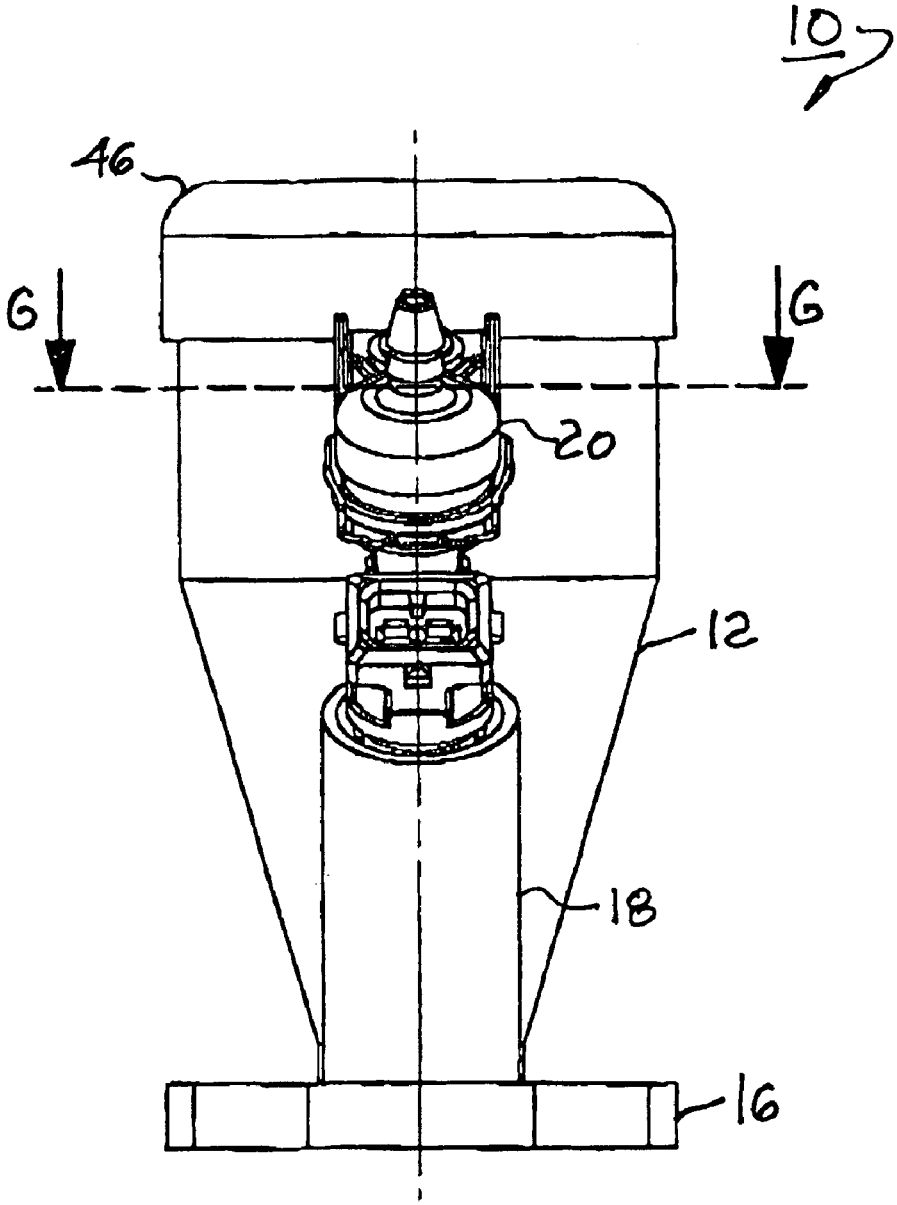
FIG. 1 is an elevational view of a poppet air inlet valve assembly, including a fuel injector, for an engine in accordance with the invention.
Figure 2:
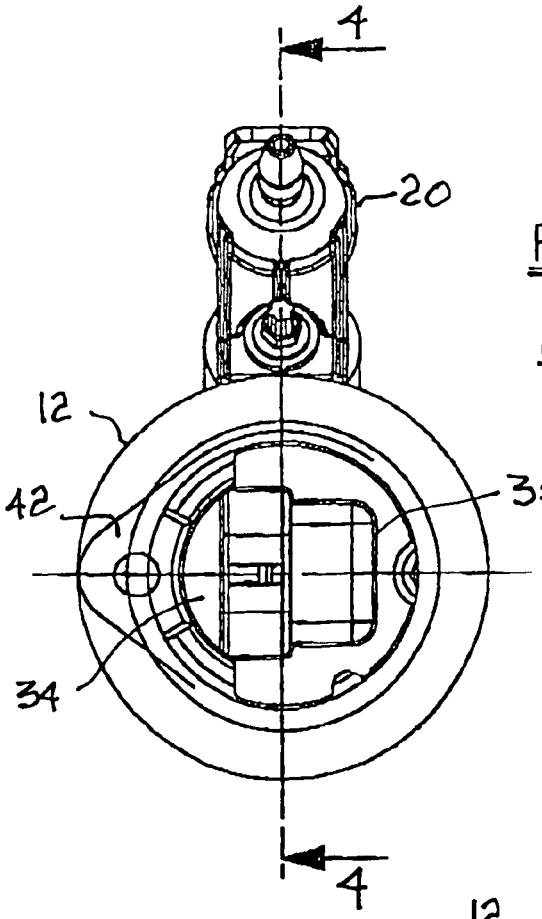
FIG. 2 is a plan view of the assembly shown in FIG. 1 with an air cleaner cover removed for clarity.
Figure 3:
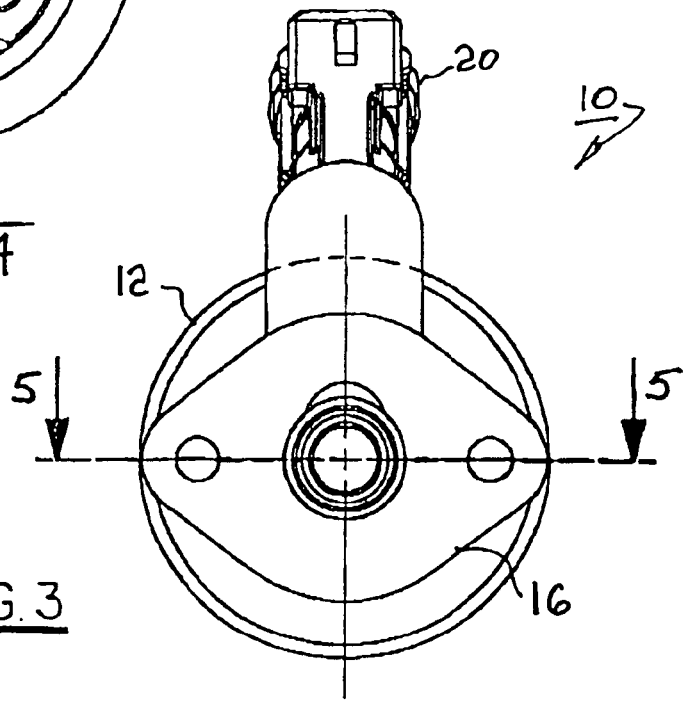
FIG. 3 is a bottom view of the assembly shown in FIG. 1.
Figure 4:
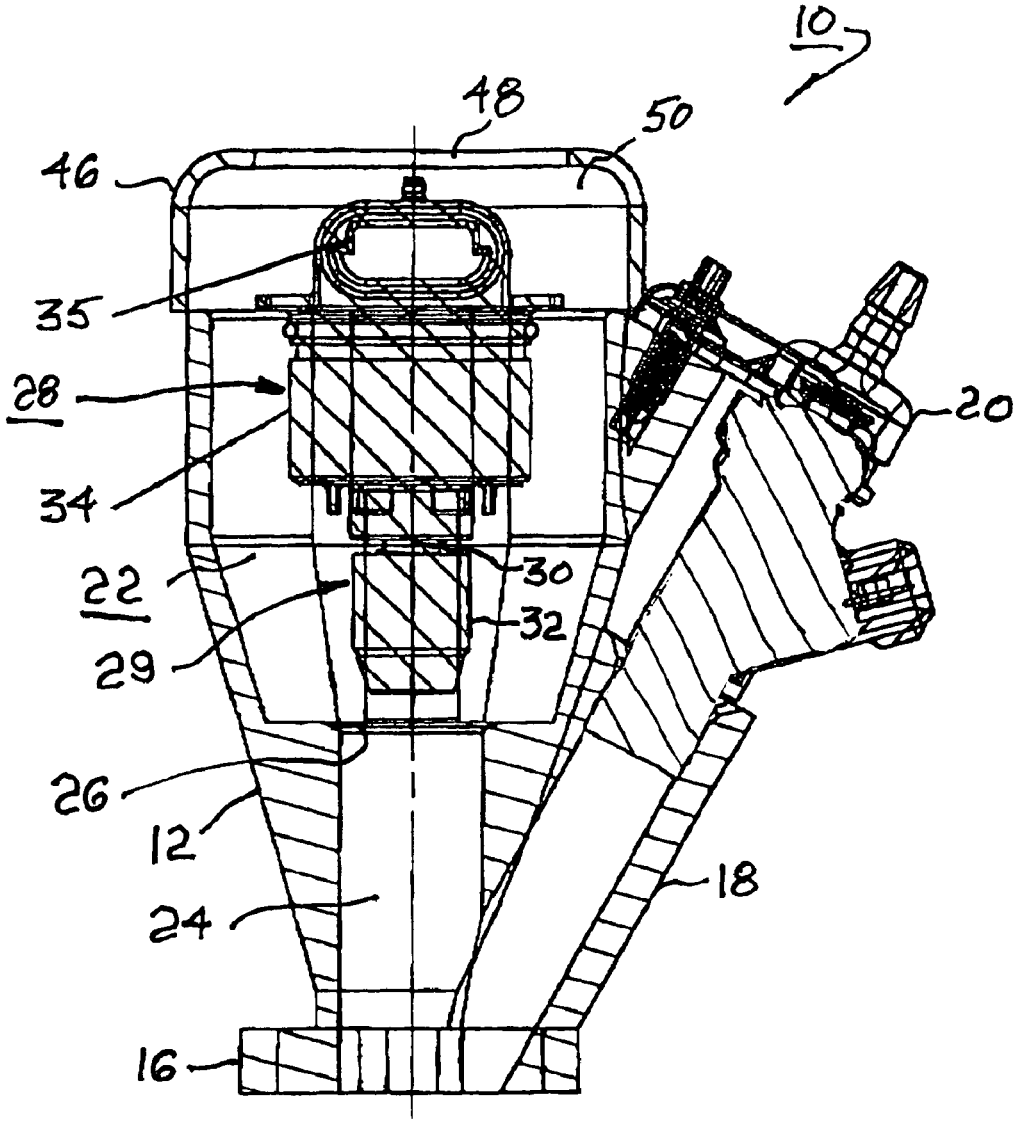
FIG. 4 is a cross-sectional view with the air cleaner cover in place taken along line 4—4 in FIG. 2.
Figure 5:
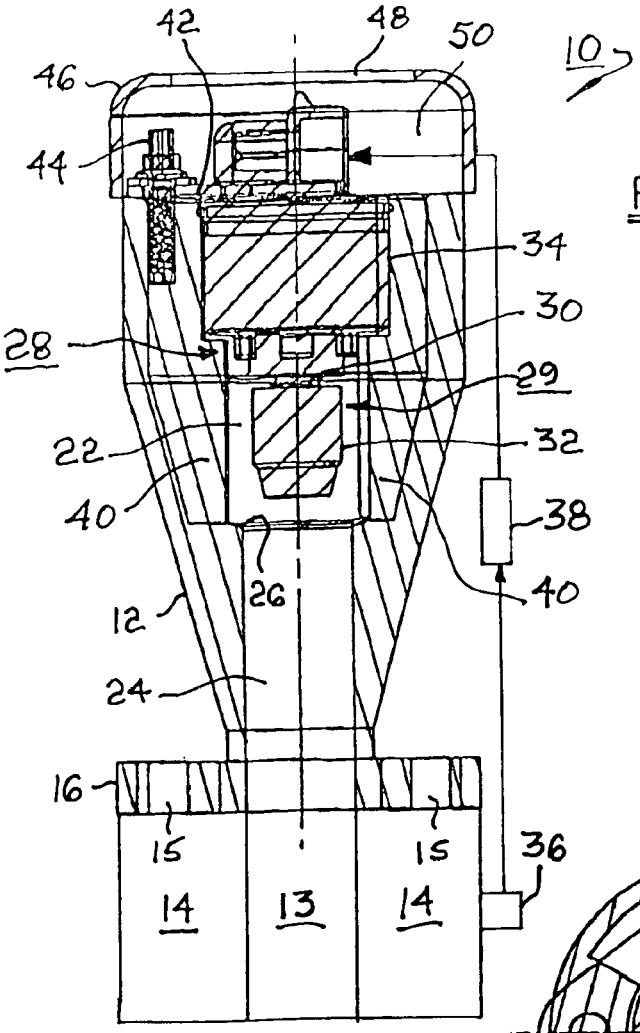
FIG. 5 is a cross-sectional view taken along line 5—5 in FIG. 3.
Figure 6:
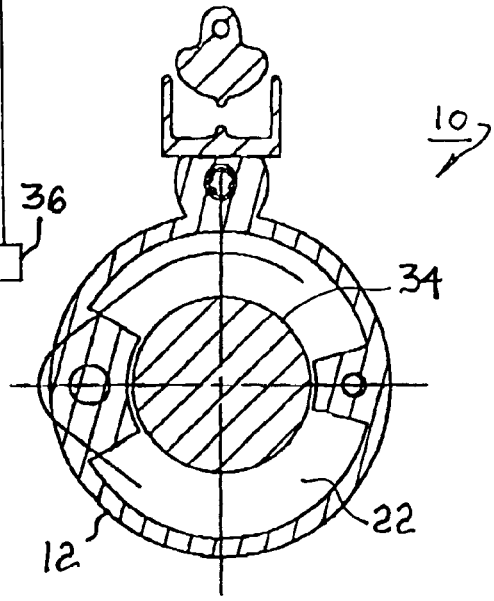
FIG. 6 is a cross-sectional view taken along line 6—6 in FIG. 1.

Referring to FIGS. 1 through 6, an engine speed control assembly 10 in accordance with the invention includes a valve housing 12 defining means for the entrance of combustion air into an internal combustion engine 14. Housing 12 is provided with a flange 16 for attachment conventionally to an intake port 13 of engine 14 (both shown schematically in FIG. 5) as by bolt holes 15. A sidearm 18 supports a conventional fuel injector 20 for providing fuel to intake port 13 in known fashion. Fuel injector 20 need not be considered further as a part of this disclosure.

Housing 12 encloses an outer chamber 22 and an inner chamber 24 separated by a valve seat 26 which is preferably circular. Inner chamber 24 defines a valve throat leading to intake port 13. Disposed in chamber 22 coaxially with seat 26 is a poppet valve assembly 28 including a pintle assembly 29 comprising a valve shaft 30 and connected valve head 32 for cooperating with seat 26 to vary the cross-sectional open area of chamber 24. Valve assembly 28 further includes a linear actuator mechanism 34 connected to and operative of pintle assembly 29. An electrical connector 35 on mechanism 34 is connected to a programmed engine control module 38 for receiving signals and power therefrom. Engine Control Module (ECM) 38 is preferably a programmable electronic semiconductor device. An engine speed sensor such as, for example, a tachometer 36 attached to engine 14 provides an input signal to engine control module 38 which signals actuator mechanism 34 to adjust the axial position of assembly 29, controllably adjusting the volume of air admitted to engine 14 across seat 26 to cause the output speed of the engine speed sensor to match the setpoint speed in the control module.

Actuator mechanism 34 may include any convenient form of linear actuator, such as a solenoid, or a linear motor and preferably comprises a linear stepper motor, preferably having a relatively large number of actuation steps. Suitable stepper motors having, for example, 197 or 320 steps are known in the prior art. The outside diameter of head 32 may be greater or lesser than the inside diameter of seat 26, as desired; however, providing a greater diameter to head 32 can be preferred because it permits seat 26 to be used as a reference stop for head 32 for self-calibration of the actuator's stroke.

Housing 12 includes radial fins 40 extending inwards for receiving, supporting, and axially positioning poppet valve assembly 28. A flange 42 extending radially from acutator mechanism 34 secures assembly 28 in housing 12 beneficially via single bolt 44.

A housing cover 46 is removably attached to housing 12, preferably by a snug friction fit. Cover 46 has an opening 48 for admission of combustion air to chamber 22, which opening may be louvered or otherwise protected in known fashion (not shown). Cover 46 further is formed to provide a chamber 50 contiguous with chamber 22 wherein an air filtration device (not shown) such as a foam or mesh may be included. A significant benefit of locating the actuator assembly directly within the intake air stream in accordance with the invention is that the actuator is continuously air cooled, which can be highly beneficial in applications wherein an actuator would otherwise be subjected to high engine operating temperatures. Further, the entire valve assembly is well protected from environmental hazards which are commonly encountered, especially in small-engine applications such as lawn mowers, shredders, chippers, rototillers, and the like.

Engine speed control assembly 10 is useful generally for controllably throttling combustion air to an internal combustion engine, although the time response characteristics of a linear actuator may limit some applications. Input to ECM 38 may come from not only engine speed sensor 36 but from an operator via, for example, and hand throttle lever or foot pedal. Further, ECM 38 may be programmed for variable engine speed response as well as for fixed speed response. Internal combustion engines for which the invention is suitable comprise at least spark-ignited gasoline piston engines, both two-cycle and four-cycle, rotary engines, and diesel engines.

While the invention has been described by reference to various specific embodiments, it should be understood that numerous changes may be made within the spirit and scope of the inventive concepts described. For example, valve assembly 28 is shown and discussed as being disposed on the upstream side of the air flow path across valve seat 26. However, assembly 10 may also be configured by one skilled in the art to invert valve assembly 28 and valve seat 26, placing assembly 28 on the downstream side of seat 26 (configuration not shown), chamber 24 thereby defining an entrance to assembly 10 rather than an exit. Accordingly, it is intended that the invention not be limited to the described embodiments, but will have full scope defined by the language of the following claims.

What is claimed is:

1. Apparatus for variably throttling flow of combustion air to an internal combustion engine, comprising:

a) a housing mountable to said engine and surrounding an intake port thereof for providing combustion air to said engine;

b) a poppet valve seat formed in said housing surrounding a chamber in communication with said intake port; and c) a poppet valve assembly disposed in said housing coaxially with said seat, said assembly including a valve head for cooperating with said seat to vary the open area of said chamber, a valve shaft attached to said valve head, and a linear actuator for axially displacing said shaft and said head with respect to said valve seat to variably throttle flow of combustion air into said engine across said valve seat, wherein said apparatus is the sole mechanism for variably throttling combustion air to the engine.

2. Apparatus in accordance with claim 1 further comprising an engine control module for signaling said linear actuator in response to an input signal.

3. Apparatus in accordance with claim 2 further comprising means for measuring rotational speed of said engine and providing said input signal representative thereof to said engine control module.

4. Apparatus in accordance with claim 3 wherein said engine control module is programmed with a setpoint representative of a desired fixed rotational speed of said engine.

5. Apparatus in accordance with claim 2 wherein said input signal is provided by an operator.

6. Apparatus in accordance with claim 1 wherein said linear actuator is selected from the group consisting of a solenoid, a linear motor and a stepper motor.

7. An internal combustion engine comprising apparatus for variably throttling flow of combustion air, including a housing mountable to said engine and surrounding an intake port thereof for providing combustion air to said engine;

a poppet valve seat formed in said housing surrounding a chamber in communication with said intake port, and a poppet valve assembly disposed in said housing coaxially with said seat, said assembly including a valve head for cooperating with said seat to vary the open area of said chamber, a valve shaft attached to said valve head, and a linear actuator for axially displacing said shaft and said head with respect to said valve seat to variably throttle flow of combustion air into said engine across said valve seat, wherein said apparatus is the sole mechanism for variably throttling combustion air to the engine.

8. An engine in accordance with claim 7 wherein said apparatus further includes an engine control module for signaling said linear actuator in response to an input signal, means for measuring rotational speed of said engine and providing said input signal representative thereof to said engine control module, said engine control module being programmed with a setpoint representative of a desired fixed rotational speed of said engine.

9. An engine in accordance with claim 7 wherein said linear actuator is selected from the group consisting of a solenoid, a linear motor and a stepper motor.

* * * * *

UNITED STATES PATENT AND TRADEMARK OFFICE

CERTIFICATE OF CORRECTION

PATENT NO. : 6,962,138 B2
APPLICATION NO. : 10/238836
DATED : November 8, 2005
INVENTOR(S) : Robert T. Garrick, Donald G. Witzel and Charles A. Iannone It is certified that error appears in the above-identified patent and that said Letters Patent is hereby corrected as shown below:

In field (75), Inventors: insert

Charles A. Iannone, W. Henrietta, NY (US)

Signed and Sealed this

Fifteenth Day of August, 2006

JON W. DUDAS
*Director of the United States Patent and Trademark Office*